US012631356B2

(12) United States Patent
Schindler

(10) Patent No.: US 12,631,356 B2
(45) **Date of Patent: *May 19, 2026**

(54) APPARATUS, COMPUTER PROGRAM PRODUCT, AND METHOD FOR EVALUATING COURSE OF DEGRADATION IN AIR HANDLING UNITS

(71) Applicant: Honeywell International Inc., Charlotte, NC (US)

(72) Inventor: Zdenek Schindler, Prague (CZ)

(73) Assignee: Honeywell International Inc., Charlotte, NC (US)

( * ) Notice: Subject to any disclaimer, the term of this patent is extended or adjusted under 35 U.S.C. 154(b) by 315 days.

This patent is subject to a terminal disclaimer.

(21) Appl. No.: 18/314,298

(22) Filed: May 9, 2023

(65) Prior Publication Data

US 2024/0377089 A1 Nov. 14, 2024

(51) Int. Cl.
*F24F 11/38* (2018.01)
*F24F 11/49* (2018.01)
*F24F 110/10* (2018.01)

(52) U.S. Cl.
CPC ..... *F24F 11/38* (2018.01); *F24F 11/49* (2018.01); *F24F 2110/10* (2018.01)

(58) Field of Classification Search
CPC .... G05B 13/04; G05B 13/041; G05B 13/042; G05B 2219/42155; G05B 2219/32201; G05B 2219/42162
See application file for complete search history.

(56) References Cited

U.S. PATENT DOCUMENTS

| | | | | |
|---|---|---|---|---|
| 11,248,819 | B2 * | 2/2022 | Slimacek | F24F 11/52 |
| 11,320,164 | B2 * | 5/2022 | Roth | F24F 11/38 |
| 11,487,277 | B2 * | 11/2022 | Turney | G05B 23/0283 |
| 11,703,246 | B2 * | 7/2023 | Alanqar | G05B 13/044 700/277 |
| 11,835,930 | B2 * | 12/2023 | Hull | G05B 15/02 |
| 2020/0090289 | A1 * | 3/2020 | Elbsat | G06Q 10/04 |
| 2020/0278669 | A1 * | 9/2020 | Brownie | G05B 23/0275 |
| 2020/0301408 | A1 * | 9/2020 | Elbsat | G06N 3/04 |
| 2023/0243539 | A1 * | 8/2023 | Buda | F25B 49/025 700/276 |
| 2023/0288882 | A1 * | 9/2023 | Maitra | G05B 13/0265 |
| 2024/0361735 | A1 * | 10/2024 | Schindler | G05B 13/048 |

* cited by examiner

*Primary Examiner* — Thomas K Pham
(74) *Attorney, Agent, or Firm* — Alston & Bird LLP

(57) ABSTRACT

Methods, apparatuses, and computer program products are disclosed for monitoring cooling coil degradation. An example method receives a first data set comprising heat transfer data over a first time interval. The method generates, with a machine learning model, a data prediction based upon the first data set, wherein the data prediction comprises expected heat transfer data over a second time interval. The method receives a second data set comprising heat transfer data over the second time interval. The method determines a cooling coil degradation level based on a difference between the data prediction and the second data set.

19 Claims, 11 Drawing Sheets

APPARATUS, COMPUTER PROGRAM PRODUCT, AND METHOD FOR EVALUATING COURSE OF DEGRADATION IN AIR HANDLING UNITS

TECHNOLOGICAL FIELD

Example embodiments of the present invention relate generally to monitoring degradation of cooling coils in air handling units and, more particularly, to determining optimal maintenance time.

BACKGROUND

Air handling units over time experience a drop in efficiency. Often, cooling coils of such air handling units degrade to cause such drops in efficiency. There is a problem with accurately tracking and evaluating impacts of the degradation of cooling coils.

BRIEF SUMMARY

Systems, apparatuses, and computer program products are disclosed herein for performing cooling coil fouling monitoring and maintenance. In an example embodiment, an apparatus is provided comprising at least one processor and at least one non-transitory memory including computer-coded instructions thereon, the computer-coded instructions configured to, with the at least one processor, cause the apparatus to receive a first data set comprising heat transfer data over a first time interval. The at least one memory and the computer-coded instructions are further configured to generate, with a machine learning model, a data prediction based at least on the first data set, wherein the data prediction comprises heat transfer over a second time interval. The at least one memory and the computer-coded instructions are further configured to receive a second data set comprising heat transfer data over the second time interval. The at least one memory and the computer-coded instructions are further configured to determine a cooling coil degradation level based on a difference between the data prediction and the second data set.

In an example embodiment, the first data set and the second data set comprise a difference between chilled water supply temperature and chilled water return temperature.

In an example embodiment, the first data set, data prediction, and second data set comprise loss in latent heat.

In an example embodiment, the cooling coil degradation level is determined based at least on a difference between a heat transfer coefficient associated with the data prediction and a heat transfer coefficient associated with the second data set.

In an example embodiment, the cooling coil degradation level is determined based at least on a difference between a logarithmic mean temperature difference associated with the data prediction and a logarithmic mean temperature difference associated with the second data set.

In an example embodiment, the at least one memory and the computer-coded instructions are further configured to determine a mixing ratio associated with the data prediction. The at least one memory and the computer-coded instructions are further configured to determine a mixing ratio associated with the second data set. The at least one memory and the computer-coded instructions are further configured to determine an energy waste level based on a difference between the mixing ratio associated with the data prediction and the mixing ratio associated with the second data set.

In an example embodiment, the at least one memory and the computer-coded instructions are further configured to determine a chiller efficiency level associated with the data prediction. The at least one memory and the computer-coded instructions are further configured to determine a chiller efficiency level associated with the second data set. The at least one memory and the computer-coded instructions are further configured to determine an energy waste level based on a difference between the chiller efficiency level associated with the data prediction and the chiller efficiency level associated with the second data set.

In an example embodiment, the at least one memory and the computer-coded instructions are further configured to determine an excess expenditure value based on the energy waste level.

In an example embodiment, the at least one memory and the computer-coded instructions are further configured to determine an optimal maintenance time based on the excess expenditure value and a cost of maintenance.

In an example embodiment, the first time interval is determined based at least on a rate of expected degradation.

In an example embodiment, the at least one memory and the computer-coded instructions are further configured to smooth the first data set, wherein the first data set is smoothed based at least on a third time interval that is longer than a basic sampling time interval and encompasses the basic sampling time interval.

In an example embodiment, the machine learning model comprises a regression model.

In an example embodiment, the machine learning model is trained based on the first data set.

In an example embodiment, a method is provided, comprising receiving a first data set comprising heat transfer data over a first time interval. The method further comprises generating, with a machine learning model, a data prediction based at least on the first data set, wherein the data prediction comprises heat transfer over a second time interval. The method further comprises receiving a second data set comprising heat transfer data over the second time interval. The method further comprises determining a cooling coil degradation level based on a difference between the data prediction and the second data set.

In an example embodiment, the first data set and the second data set comprise a difference between chilled water supply temperature and chilled water return temperature.

In an example embodiment, the first data set, data prediction, and second data set comprise loss in latent heat.

In an example embodiment, the cooling coil degradation level is determined based at least on a difference between a heat transfer coefficient associated with the data prediction and a heat transfer coefficient associated with the second data set.

In an example embodiment, the cooling coil degradation level is determined based at least on a difference between a logarithmic mean temperature difference associated with the data prediction and a logarithmic mean temperature difference associated with the second data set.

The method of an example embodiment further comprises determining a mixing ratio associated with the data prediction. The method further comprises determining a mixing ratio associated with the second data set. The method further comprises determining an energy waste level based on a difference between the mixing ratio associated with the data prediction and the mixing ratio associated with the second data set.

The method of an example embodiment further comprises determining a chiller efficiency level associated with the data prediction. The method further comprises determining a chiller efficiency level associated with the second data set. The method further comprises determining an energy waste level based on a difference between the chiller efficiency level associated with the data prediction and the chiller efficiency level associated with the second data set.

The method of an example embodiment further comprises determining an excess expenditure value based on the energy waste level.

The method of an example embodiment further comprises determining an optimal maintenance time based on the excess expenditure value and a cost of maintenance.

In an example embodiment, the first time interval is determined based at least on a rate of expected degradation.

The method of an example embodiment further comprises smoothing the first data set, wherein the first data set is smoothed based at least on a third time interval that is longer than a basic sampling time interval and encompasses the basic sampling time interval.

In an example embodiment, the machine learning model comprises a regression model.

In an example embodiment, the machine learning model is trained based on a first data set.

In an example embodiment, a non-transitory computer readable storage medium is provided comprising computer coded instructions that, when executed by an apparatus, cause the apparatus to receive a first data set comprising heat transfer data over a first time interval. The non-transitory computer readable storage medium further includes computer instructions configured, upon execution, to generate, with a machine learning model, a data prediction based at least on the first data set, wherein the data prediction comprises heat transfer over a second time interval. The non-transitory computer readable storage medium further includes computer instructions configured, upon execution, to receive a second data set comprising heat transfer data over the second time interval. The non-transitory computer readable storage medium further includes computer instructions configured, upon execution, to determine a cooling coil degradation level based on a difference between the data prediction and the second data set.

In an example embodiment, the first data set and the second data set comprise a difference between chilled water supply temperature and chilled water return temperature.

In an example embodiment, the first data set, data prediction, and second data set comprise loss in latent heat.

In an example embodiment, the cooling coil degradation level is determined based at least on a difference between a heat transfer coefficient associated with the data prediction and a heat transfer coefficient associated with the second data set.

In an example embodiment, the cooling coil degradation level is determined based at least on a difference between a logarithmic mean temperature difference associated with the data prediction and a logarithmic mean temperature difference associated with the second data set.

The non-transitory computer readable storage medium of an example embodiment further includes computer instructions configured, upon execution, to determine a mixing ratio associated with the data prediction. The non-transitory computer readable storage medium further includes computer instructions configured, upon execution, to determine a mixing ratio associated with the second data set. The non-transitory computer readable storage medium further includes computer instructions configured, upon execution, to determine an energy waste level based on a difference between the mixing ratio associated with the data prediction and the mixing ratio associated with the second data set.

The non-transitory computer readable storage medium of an example embodiment further includes computer instructions configured, upon execution, to determine a chiller efficiency level associated with the data prediction. The non-transitory computer readable storage medium further includes computer instructions configured, upon execution, to determine a chiller efficiency level associated with the second data set. The non-transitory computer readable storage medium further includes computer instructions configured, upon execution, to determine an energy waste level based on a difference between the chiller efficiency level associated with the data prediction and the chiller efficiency level associated with the second data set.

The non-transitory computer readable storage medium of an example embodiment further includes computer instructions configured, upon execution, to determine an excess expenditure value based on the energy waste level.

The non-transitory computer readable storage medium further includes computer instructions configured, upon execution, to determine an optimal maintenance time based on the excess expenditure value and a cost of maintenance.

In an example embodiment, the first time interval is determined based at least on a rate of expected degradation.

The non-transitory computer readable storage medium further includes computer instructions configured, upon execution, to smooth the first data set, wherein the first data set is smoothed based at least on a third time interval that is longer than a basic sampling time interval and encompasses the basic sampling time interval.

In an example embodiment, the machine learning model comprises a regression model.

In an example embodiment, the machine learning model is trained based on a first data set.

BRIEF DESCRIPTION OF THE DRAWINGS

Having described certain example embodiments of the present disclosure in general terms above, reference will now be made to the accompanying drawings. The components illustrated in the figures may or may not be present in certain embodiments described herein. Some embodiments may include fewer (or more) components than those shown in the figures.

DETAILED DESCRIPTION

Figure 1:
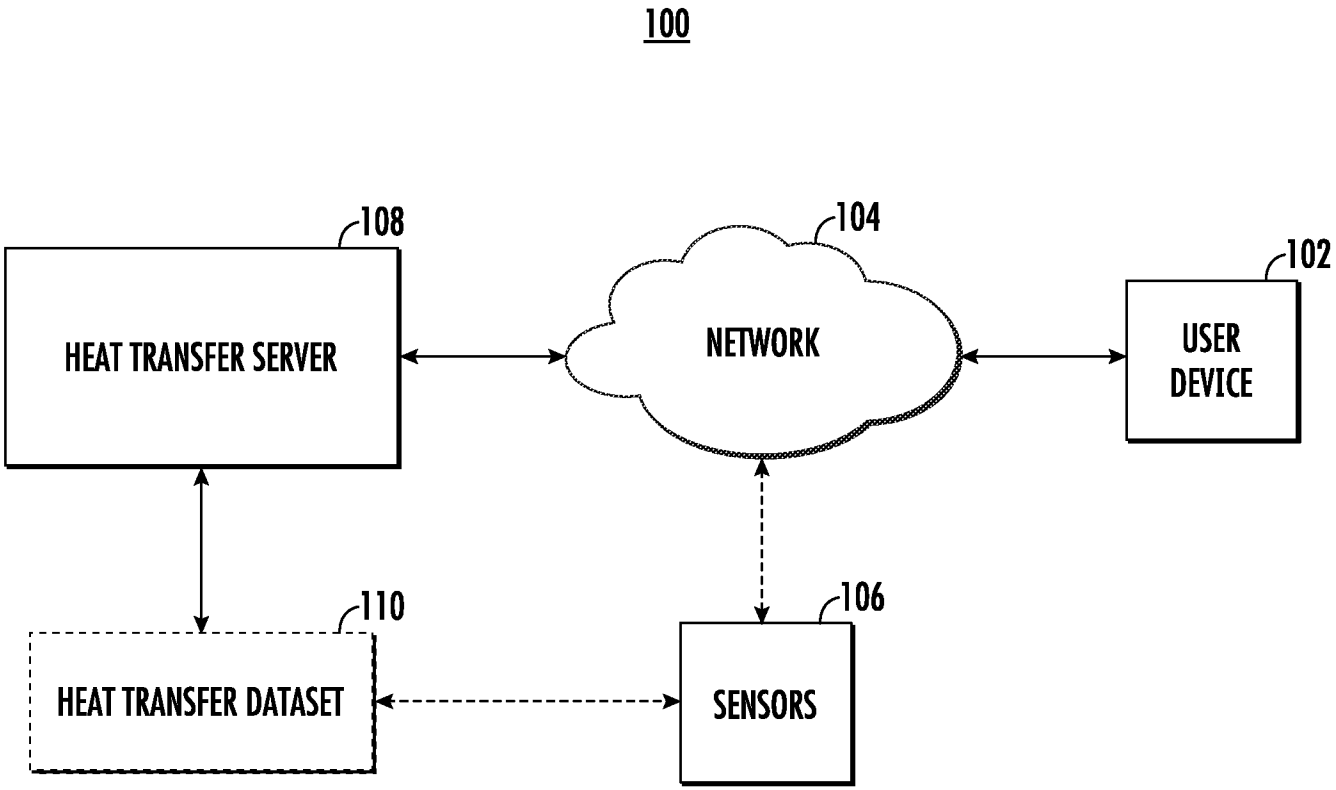
FIG. 1 illustrates a system diagram including devices that may be involved in some example embodiments described herein.

Some embodiments of the present invention will now be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout. As used herein, the description may refer to a heat transfer server as an example "apparatus." However, elements of the apparatus described herein may be equally applicable to the claimed method and computer program product. Thus, use of any such terms should not be taken to limit the spirit and scope of embodiments of the present invention.

Definition of Terms

As used herein, the terms "data," "content," "information," "electronic information," "signal," "command," and similar terms may be used interchangeably to refer to data capable of being transmitted, received, and/or stored in accordance with embodiments of the present disclosure. Thus, use of any such terms should not be taken to limit the spirit or scope of embodiments of the present disclosure. Further, where a first computing device is described herein to receive data from a second computing device, it will be appreciated that the data may be received directly from the second computing device or may be received indirectly via one or more intermediary computing devices, such as, for example, one or more servers, relays, routers, network access points, base stations, hosts, and/or the like, sometimes referred to herein as a "network." Similarly, where a first computing device is described herein as sending data to a second computing device, it will be appreciated that the data may be sent directly to the second computing device or may be sent indirectly via one or more intermediary computing devices, such as, for example, one or more servers, remote servers, cloud-based servers (e.g., cloud utilities), relays, routers, network access points, base stations, hosts, and/or the like.

As used herein, the term "comprising" means including but not limited to and should be interpreted in the manner it is typically used in the patent context. Use of broader terms such as comprises, includes, and having should be understood to provide support for narrower terms such as consisting of, consisting essentially of, and comprised substantially of.

As used herein, the phrases "in one embodiment," "according to one embodiment," "in some embodiments," and the like generally refer to the fact that the particular feature, structure, or characteristic following the phrase may be included in at least one embodiment of the present disclosure. Thus, the particular feature, structure, or characteristic may be included in more than one embodiment of the present disclosure such that these phrases do not necessarily refer to the same embodiment.

As used herein, the word "example" is used herein to mean "serving as an example, instance, or illustration." Any implementation described herein as "example" is not necessarily to be construed as preferred or advantageous over other implementations.

As used herein, the terms "user device," "mobile device," "electronic device" and the like refer to computer hardware that is configured (either physically or by the execution of software) to access one or more services made available by a heat transfer server (e.g., apparatus or computing device of the present disclosure) and, among various other functions, is configured to directly, or indirectly, transmit and receive data. Example user devices may include a smartphone, a tablet computer, a laptop computer, a wearable device (e.g., smart glasses, smart watch, or the like), and the like. In some embodiments, a user device may include a "smart device" that is equipped with a chip or other electronic device that is configured to communicate with the apparatus via Bluetooth, NFC, Wi-Fi, 3G, 4G, 5G, RFID protocols, and the like. By way of a particular example, a user device may be a mobile phone equipped with a Wi-Fi radio that is configured to communicate with a Wi-Fi access point that is in communication with the heat transfer server 108 or other computing device via a network.

As used herein, the term "sensor" or "sensors" refer to any object, device, or system which may be in network communication with the heat transfer server and/or the user device that is configured to monitor or generate heat transfer data. The sensors may be configured to generate heat transfer data and iteratively transmit this data to the heat transfer server 108. For example, the sensors may refer to a temperature sensor configured to determine the temperature of chilled water proximate the sensors (e.g., in degrees Celsius or the like).

As used herein, the term "heat transfer dataset" refers to a data structure or repository for storing sensor data, time data, temperature data, volumetric flow data, and the like. In some embodiments, the heat transfer dataset is accessible by one or more software applications of the heat transfer server.

As used herein, the term "computer-readable medium" refers to non-transitory storage hardware, non-transitory storage device or non-transitory computer system memory that may be accessed by a controller, a microcontroller, a computational system, or a module of a computational system to encode thereon computer-executable instructions or software programs. A non-transitory "computer-readable medium" may be accessed by a computational system or a module of a computational system to retrieve and/or execute the computer-executable instructions or software programs encoded on the medium. Exemplary non-transitory computer-readable media may include, but are not limited to, one or more types of hardware memory, non-transitory tangible media (for example, one or more magnetic storage disks, one or more optical disks, one or more USB flash drives), computer system memory or random access memory (such as, DRAM, SRAM, EDO RAM), and the like.

Having set forth a series of definitions called-upon throughout this application, an example system architecture and example apparatus is described below for implementing example embodiments and features of the present disclosure.

Overview

Often, various electrical and/or mechanical components, for example cooling coils of an air handling unit, will degrade over time due to any of a myriad of internal and/or external influences. As a result, older cooling coils will require colder supply cooling fluids (e.g., water or the like) or a higher volumetric flow rate of the cooling fluid to produce the same chilling effect as new cooling coils. Additionally, as older cooling coils caused higher energy consumption, that wasted energy translates into increased costs over time for the same air handling unit performance. It is desirable to monitor cooling coil degradation to determine an optimal maintenance time for maintaining air handling unit efficiency while simultaneously minimizing maintenance resource expenditure and minimizing costs incurred to perform the maintenance.

Embodiments provide for improved monitoring of cooling coil degradation and maintenance optimization. For example, embodiments provide technical advantages by accurately determining a degradation level of cooling coils. In one or more embodiments, an accurate level of degradation in cooling coils is provided by determining a difference between collected data and predicted data generated by using a machine learning model.

As an additional example, embodiments provide technical advantages by accurately predicting future degradation of cooling coils based on a determined level of degradation. In one or more embodiments, a degradation level can be predicted ahead of time using the accurate level of degradation determined by embodiments herein.

As an additional example, embodiments provide technical advantages by optimizing cooling coil maintenance. In one or more embodiments, a predicted degradation level can be analyzed to determine an optimal time to perform maintenance on the air handling unit. Performing maintenance at an optimal time reduces total energy and maintenance expenditure compared to cooling coils that have maintenance performed before or after the optimal time.

As an additional example, embodiments herein provide technical advantages by causing total energy demand of a cooling source associated with an air handling unit to be reduced. In one or more embodiments, by determining an accurate level of degradation and performing maintenance at an optimal time, air handling unit total operation costs can be reduced compared to air handling units that have maintenance performed before or after the optimal maintenance time.

Device Architecture and Example Apparatus

With reference to FIG. 1, an example system 100 is illustrated with an apparatus (e.g., a heat transfer server 108 as described further herein) communicably connected via a network 104 to a user device 102 and sensors 106. The example system 100 may also include a heat transfer dataset 110 that may be hosted by the heat transfer server 108 or otherwise hosted by devices in communication with the heat transfer server 108.

The heat transfer server 108 may include circuitry, networked processors, or the like configured to perform some or all of the apparatus-based (e.g., heat transfer server-based) processes described herein, and may be any suitable network server and/or other type of processing device. Heat transfer server 108 may include one or more server(s), database(s), computing device(s), and/or the like connected by one or more communication networks. In this regard, heat transfer server 108 may be embodied by any of a variety of devices. For example, the heat transfer server 108 may be configured to receive/transmit data and may include any of a variety of fixed terminals, such as a server, desktop, or kiosk, or it may comprise any of a variety of mobile terminals, such as a portable digital assistant (PDA), mobile telephone, smartphone, laptop computer, tablet computer, or in some embodiments, a peripheral device that connects to one or more fixed or mobile terminals. Example embodiments contemplated herein may have various form factors and designs but will nevertheless include at least the components illustrated in FIG. 2 and described in connection therewith. In some embodiments, the heat transfer server 108 may be located remotely from the sensors 106, the user device 102, and/or heat transfer dataset 110, although in other embodiments, the heat transfer server 108 may comprise the sensors 106, the user device 102, and/or the heat transfer dataset 110. The heat transfer server 108 may, in some embodiments, comprise several servers or computing devices performing interconnected and/or distributed functions. Said differently, in some embodiments the heat transfer server 108 may be configured as a locally hosted server, a cloud-based server, a distributed server, or a peer-to-peer network of connected devices (e.g., user devices comprising the heat transfer server functionality). Regardless of such arrangements contemplated herein, the heat transfer server 108 is shown and described herein as a single computing device to avoid unnecessarily overcomplicating the disclosure.

The network 104 may include one or more wired and/or wireless communication networks including, for example, a wired or wireless local area network (LAN), personal area network (PAN), metropolitan area network (MAN), wide area network (WAN), or the like, as well as any hardware, software and/or firmware for implementing the one or more networks (e.g., network routers, switches, hubs, etc.). For example, the network 104 may include a cellular telephone, mobile broadband, long term evolution (LTE), GSM/EDGE, UMTS/HSPA, IEEE 802.11, IEEE 802.16, IEEE 802.20, Wi-Fi, dial-up, and/or WiMAX network. Furthermore, the network 104 may include a public network, such as the Internet, a private network, such as an intranet, or combinations thereof, and may utilize a variety of networking protocols now available or later developed including, but not limited to TCP/IP based networking protocols.

The user device 102 may refer to a mobile device associated with a user and may be a cellular telephone (e.g., a smartphone and/or other type of mobile telephone), laptop, desktop, tablet, electronic reader, e-book device, media device, wearable, smart glasses, smartwatch, or any combination of the above. Although only a user device 102 is illustrated, the example system 100 may include any number of user devices associated with the same user or any number of respective other users. By way of example, in an instance in which the example system 100 operates as a peer-to-peer networking, the heat transfer server 108 may be in communication with a plurality of user devices.

As noted above, the sensors 106 may refer to any object, device, or system which may be in network communication with the heat transfer server and/or the user device and configured to generate heat transfer data. For example, the sensors may refer to a temperature sensor configured to determine the temperature of a chilled medium proximate the sensors (e.g., in degrees Celsius or the like). While described herein with reference to temperature, volumetric flow rate, and power consumption sensors, the present disclosure contemplates that any number of additional sensors may be used to determine efficiency levels of an air handling unit (e.g., through pressure or the like) and/or that the sensors 106 may be configured to determine one or more additional operating parameters of the system 100.

The heat transfer dataset 110 may be stored by any suitable storage device configured to store some or all of the information described herein (e.g., memory 204 of the heat transfer server 108 or a separate memory system separate from the heat transfer server 108, such as one or more database systems, backend data servers, network databases, cloud storage devices, or the like provided by another device (e.g., online application or 3$^{rd}$ party provider) or the user device 102). The heat transfer dataset 110 may comprise data received from the heat transfer server 108 (e.g., via a memory 204 and/or processor(s) 202), the sensors 106, or the user device 102, and the corresponding storage device may thus store this data. In some embodiments, the heat transfer dataset is accessible by one or more software applications of the heat transfer server 108.

Figure 2:
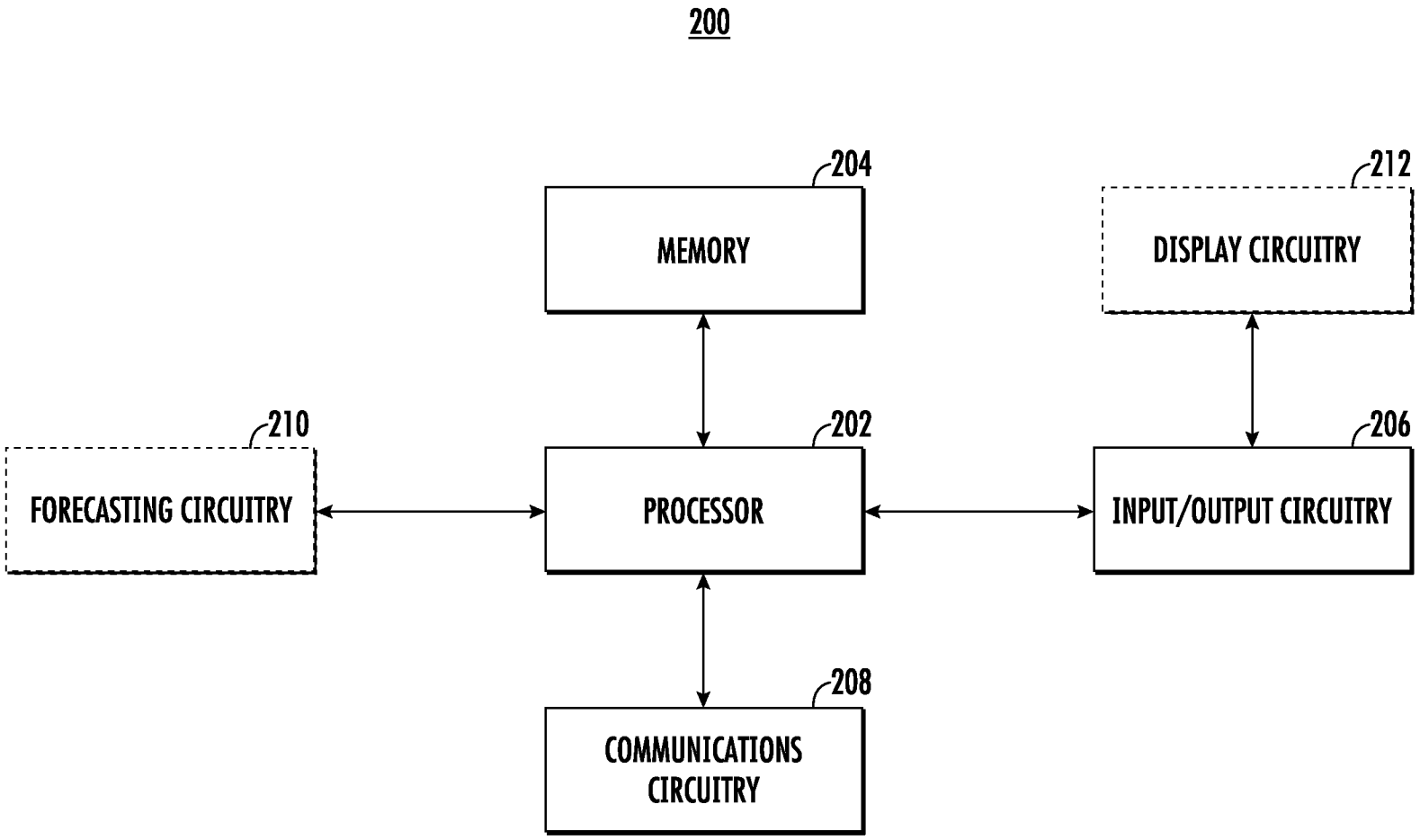
FIG. 2 illustrates a schematic block diagram of example circuitry that may perform various operations, in accordance with some example embodiments described herein.

As illustrated in FIG. 2, the heat transfer server 108 may include a processor 202, a memory 204, communications circuitry 208, input/output circuitry 206, and, in some embodiments, display circuitry 212 and forecasting circuitry 210. The heat transfer server 108 may be configured to execute the operations described below in connection with FIGS. 9-10. Although components 202-212 are described in some cases using functional language, it should be understood that the particular implementations necessarily include the use of particular hardware. It should also be understood that certain of these components 202-212 may include similar or common hardware. For example, two sets of circuitry may both leverage use of the same processor 202, memory 204, communications circuitry 208, or the like to perform their associated functions, such that duplicate hardware is not required for each set of circuitry. The use of the term "circuitry" as used herein includes particular hardware configured to perform the functions associated with respective circuitry described herein. As described in the example above, in some embodiments, various elements or components of the circuitry of the heat transfer server 108 may be housed within the sensors 106 and/or the user device 102. It will be understood in this regard that some of the components described in connection with the heat transfer server 108 may be housed within one of these devices, while other components are housed within another of these devices, or by yet another device not expressly illustrated in FIG. 1.

Of course, while the term "circuitry" should be understood broadly to include hardware, in some embodiments, the term "circuitry" may also include software for configuring the hardware. For example, although "circuitry" may include processing circuitry, storage media, network interfaces, input/output devices, and the like, other elements of the heat transfer server 108 may provide or supplement the functionality of particular circuitry.

In some embodiments, the processor 202 (and/or co-processor or any other processing circuitry assisting or otherwise associated with the processor) may be in communication with the memory 204 via a bus for passing information among components of the heat transfer server 108. The memory 204 may be non-transitory and may include, for example, one or more volatile and/or non-volatile memories. In other words, for example, the memory may be an electronic storage device (e.g., a non-transitory computer readable storage medium). The memory 204 may be configured to store information, data, content, applications, instructions, or the like, for enabling the heat transfer server 108 to carry out various functions in accordance with example embodiments of the present invention.

The processor 202 may be embodied in a number of different ways and may, for example, include one or more processing devices configured to perform independently. Additionally, or alternatively, the processor may include one or more processors configured in tandem via a bus to enable independent execution of instructions, pipelining, and/or multithreading. The use of the term "processing circuitry" may be understood to include a single core processor, a multi-core processor, multiple processors internal to the heat transfer server, and/or remote or "cloud" processors.

In an example embodiment, the processor 202 may be configured to execute instructions stored in the memory 204 or otherwise accessible to the processor 202. Alternatively, or additionally, the processor 202 may be configured to execute hard-coded functionality. As such, whether configured by hardware or by a combination of hardware with software, the processor 202 may represent an entity (e.g., physically embodied in circuitry) capable of performing operations according to an embodiment of the present invention while configured accordingly. Alternatively, as another example, when the processor 202 is embodied as an executor of software instructions, the instructions may specifically configure the processor 202 to perform the algorithms and/or operations described herein when the instructions are executed.

The heat transfer server 108 further includes input/output circuitry 206 that may, in turn, be in communication with processor 202 to provide output to a user and to receive input from a user, user device, or another source. In this regard, the input/output circuitry 206 may comprise display circuitry 212 that may be manipulated by a mobile application. In some embodiments, the input/output circuitry 206 may also include additional functionality such as a keyboard, a mouse, a joystick, a touch screen, touch areas, soft keys, a microphone, a speaker, or other input/output mechanisms. The processor 202 and/or user interface circuitry comprising the processor 202 may be configured to control one or more functions of a display through computer program instructions (e.g., software and/or firmware) stored on a memory accessible to the processor (e.g., memory 204, and/or the like).

The communications circuitry 208 may be any means such as a device or circuitry embodied in either hardware or a combination of hardware and software that is configured to receive and/or transmit data from/to a network and/or any other device, circuitry, or module in communication with the heat transfer server 108. In this regard, the communications circuitry 208 may include, for example, a network interface for enabling communications with a wired or wireless communication network. For example, the communications circuitry 208 may include one or more network interface cards, antennae, buses, switches, routers, modems, and supporting hardware and/or software, or any other device suitable for enabling communications via a network. Additionally, or alternatively, the communication interface may include the circuitry for interacting with the antenna(s) to cause transmission of signals via the antenna(s) or to handle receipt of signals received via the antenna(s). These signals may be transmitted by the heat transfer server 108 using any of a number of wireless personal area network (PAN) technologies, such as Bluetooth® v1.0 through v3.0, Bluetooth Low Energy (BLE), infrared wireless (e.g., IrDA), ultra-wideband (UWB), induction wireless transmission, or the like. In addition, it should be understood that these signals may be transmitted using Wi-Fi, Near Field Communications (NFC), Worldwide Interoperability for Microwave Access (WiMAX) or other proximity-based communications protocols.

The forecasting circuitry 210 includes hardware components designed to generate temperature predictions, coefficient of performance forecasts, and power consumption forecasts. The forecasting circuitry 210 may utilize processing circuitry, such as the processor 202, to perform its corresponding operations, and may utilize memory 204 to store collected information. By way of example, in some instances, the forecasting circuitry 210 may query the heat transfer dataset 110 to receive heat transfer data. Additionally or alternatively, in some embodiments the forecasting circuitry 210 receives the heat transfer data, for example directly from one or more sensors.

In addition, computer program instructions and/or other type of code may be loaded onto a computer, processor or other programmable heat transfer server's circuitry to produce a machine, such that the computer, processor other programmable circuitry that execute the code on the machine create the means for implementing the various functions, including those described in connection with the components of heat transfer server 108.

As described above and as will be appreciated based on this disclosure, embodiments of the present invention may be configured as systems, methods, mobile devices, and the like. Accordingly, embodiments may comprise various means including entirely of hardware or any combination of software with hardware. Furthermore, embodiments may take the form of a computer program product comprising instructions stored on at least one non-transitory computer-readable storage medium (e.g., computer software stored on a hardware device). Any suitable computer-readable storage medium may be utilized including non-transitory hard disks, CD-ROMs, flash memory, optical storage devices, or magnetic storage devices.

Figure 3:
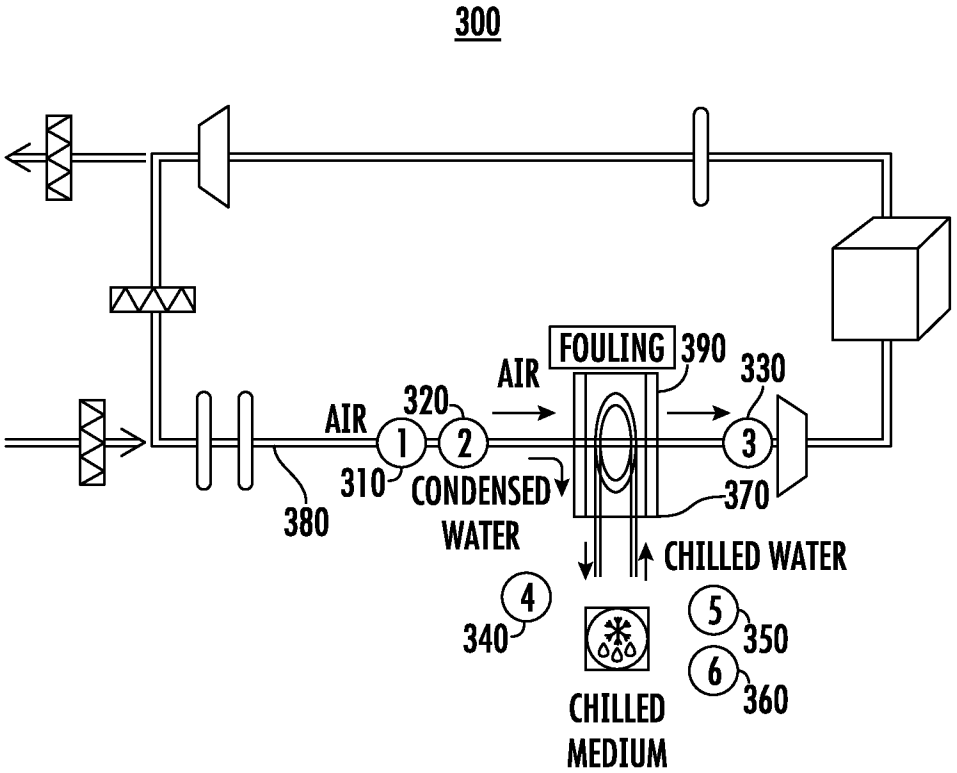
FIG. 3 illustrates an example air handling unit and set of air handling unit sensors, in accordance with some example embodiments described herein.

Example Operations for Air Handling Unit Efficiency Monitoring and Maintenance Turning now to FIG. 3, an example air handling unit 300 and sensors are illustrated. The illustrated air handling unit 300 comprises air running through channel 380 into a unit 390 containing cooling coils 370. In an example embodiment, hot air runs through channel 380 and chilled water runs through the pipes of cooling coils 370. Heat is transferred from the air to the chilled water, resulting in cooler air temperature and higher water temperature. However, the illustrated embodiment is not limiting of types of air handling units that may be used. For example, another example embodiment may comprise cooling coils containing a non-water chilled medium. Other types of air handling unit embodiments recognized by one of ordinary skill in the art may be applied to these embodiments.

In an example embodiment, sensor 310 comprises a humidity sensor configured to read the absolute or relative humidity of hot air prior to passing through cooling coils of unit 390. Sensor 310 may comprise any type of humidity sensor such as a capacitive humidity sensor, resistive humidity sensor, thermal conductivity humidity sensor, or the like. In one or more embodiments, the absolute or relative humidity read by sensor 310 is stored in the heat transfer dataset.

In one or more embodiments, temperature sensor 320 is configured to read the temperature of the hot air prior to passing through cooling coils of unit 390. Sensor 320 may comprise any type of temperature sensor such as a thermocouple, resistance temperature detector, thermistor, semiconductor based integrated circuit, or the like. In one or more embodiments, the individual temperatures read by sensor 320 are stored in the heat transfer dataset.

In one or more embodiments, temperature sensor 330 is configured to read the temperature of the hot air subsequent to passing through unit 390. Sensor 330 may comprise any type of temperature sensor such as a thermocouple, resistance temperature detector, thermistor, semiconductor based integrated circuit, or the like. In one or more embodiments, the individual temperatures read by sensor 320 are stored in the heat transfer dataset. In one or more embodiments, differences between temperatures read by sensor 320 and sensor 330 may be stored in the heat transfer dataset.

In one or more embodiments, temperature sensor 340 is configured to read the temperature of the chilled water subsequent to passing through unit 390. Sensor 340 may comprise any type of temperature sensor such as a thermocouple, resistance temperature detector, thermistor, semiconductor based integrated circuit, or the like. In one or more embodiments, the individual temperatures read by sensor 340 are stored in the heat transfer dataset.

In one or more embodiments, temperature sensor 350 is configured to read or otherwise measure the temperature of the chilled water prior to passing through unit 390. Sensor 350 may comprise any type of temperature sensor such as a thermocouple, resistance temperature detector, thermistor, semiconductor based integrated circuit, or the like. In one or more embodiments, the individual temperatures read by sensor 350 are stored in the heat transfer dataset. In one or more embodiments, differences between temperatures read by sensor 340 and sensor 350 are stored in the heat transfer dataset.

In one or more embodiments, sensor 360 is configured to read the volumetric or mass flow rate of the chilled water prior to passing through unit 390. Sensor 360 may comprise any type of volumetric or mass flow sensor such as a positive displacement flow meter, turbine flow meter, electromagnetic flow meter, vortex meter, ultrasonic flow meter, or the like. In one or more alternative embodiments, sensor 360 may be configured to read the volumetric or mass flow rate of the chilled water subsequent to passing through unit 390. In one or more embodiments, the volumetric or mass flow rate read by sensor 360 may be stored in the heat transfer dataset. In one or more embodiments, a volumetric flow rate read by sensor 360 can be converted to a mass flow rate by multiplying volumetric flow by fluid density. In one or more embodiments, fluid density depends on the temperature of the fluid read from sensors 320-350. In one or more embodiments, chilled medium mass flow rate chwmassflow is calculated as chwmassflow=c*chwflow, where chwflow represents volumetric flow and c describes a specific mass of water at the place of volumetric flow measurement.

In one or more embodiments, cooling coil degradation may be best monitored if there is a continuous set of data from sensors 310-360. In one or more embodiments, cooling coil degradation monitoring is optimized when there are as few missing or erroneous data values as possible. In one or more embodiments, filtering is performed to optimize the heat transfer dataset. In one or more embodiments, periods of idle or inactive operation by an air handling unit are omitted from the data collected by sensors 310-360, as cooling coil fouling is not occurring during these periods of time.

In one or more embodiments, the data collected by sensors 310-360 may be smoothed. In one or more embodiments, smoothing may be performed on the data due to natural noise in the data. In one or more embodiments, appropriate filtering of the data may be performed before and after data processing. In one or more embodiments, filtering may occur only before or only after data processing. In one or more embodiments, smoothing comprises averaging the data over a longer period of time than the time period which the data represents. For example, a for one minute of collecting data, a ten minute average may be applied. In one or more embodiments, this is a moving average, where the average minute over the previous 10 minutes of data may be taken to represent a minute of data. In one or more embodiments where a new sample rate is chosen, resampling is performed, where each new sampling time point is assigned an average of all previous samples that the sampling time point contained. For example, if one minute samples are replaced with ten minute samples, each ten minute samples is assigned an average of the one minute samples over the course of the ten minute sample. In one or more embodiments, shorter and longer time periods may be used to smooth the data. In one or more embodiments, a ten minute average is applied to one minute of data prior to data processing and a six hour average is applied to the data after processing. In one or more embodiments, results are further smoothed for clarity to show degradation, which may occur slowly.

Figure 4:
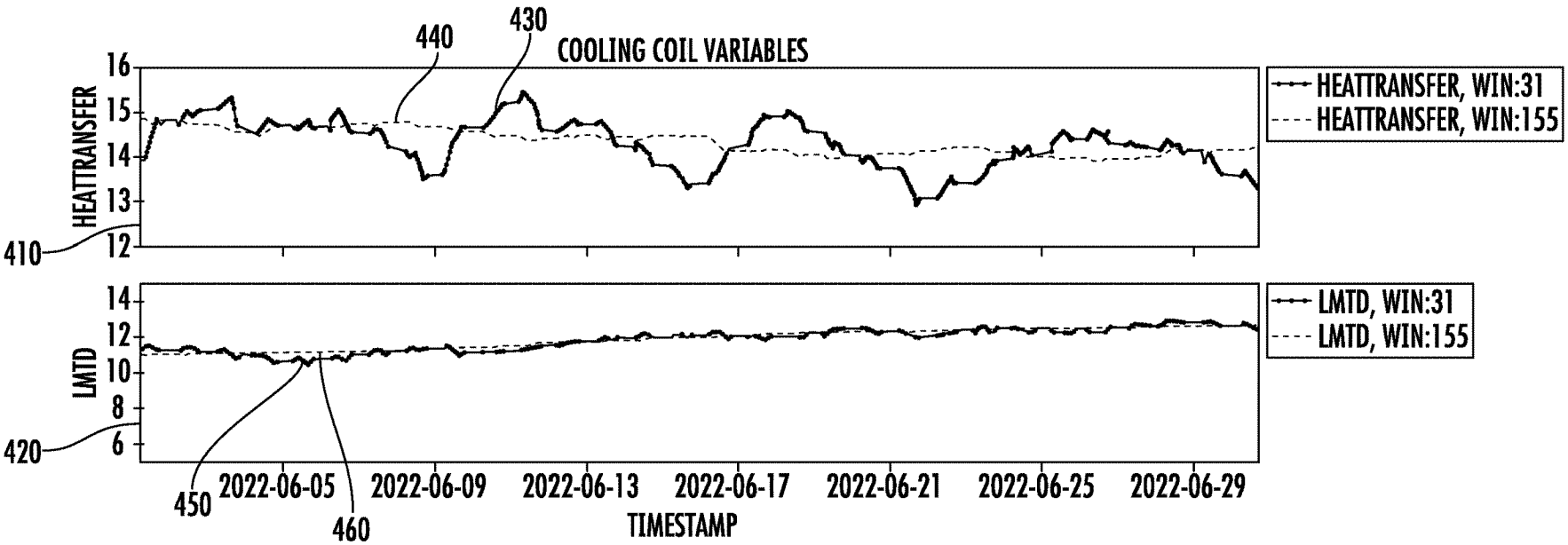
FIG. 4 illustrates example graphs of cooling coil degradation, in accordance with some example embodiments described herein.

Turning now to FIG. 4, a plurality of graphs are provided illustrating the effects of cooling coil fouling. In one or more embodiments, graph 410 illustrates the effect of cooling coil fouling on heat transfer capability. In one or more embodiments, cooling coil fouling leads to heat transfer capability degradation in cooling coils, for example, cooling coils 370 of unit 390. In one or more embodiments, heat transfer degradation results in a necessity to decrease supply water temperature or increase mass flow rate in the cooling coil in order to produce the same cooling effect. In one or more embodiments, the colder supply of chilled water can be detected at sensor 350. In one or more embodiments, heat transfer capability degradation may be tracked by evaluating heat transfer coefficient as transferred heat divided by logarithmic mean temperature difference. In one or more embodiments, a heat transfer coefficient may be determined based on the air temperatures read at sensors 320-330, the water temperatures read at sensors 340-350, and water volumetric or mass flow rate read at sensor 360. In one or more embodiments, a heat transfer coefficient of cooling coils over time is shown in line 430. In one or more embodiments, the data is smoothed using techniques describes above to generate line 440. In one or more embodiments, the resulting lines illustrate a decrease in heat transfer capabilities.

In one or more embodiments, graph 420 illustrates cooling coil fouling progress by using Logarithmic Mean Temperature Difference (LMTD). In one or more embodiments, the LMTD is based on differences between air temperature read at sensors 320 and 330 and chilled water temperatures read at sensor 350 and sensor 340. In one or more embodiments, the LMTD is stored in heat transfer dataset 110. In one or more embodiments, the increase in LMTD over time is illustrated by line 450. In one or more embodiments, the data is smoothed using techniques described above to generate line 460.

Additionally or alternatively, an HVAC control system may increase the volumetric or mass flow rate of the supply water. In one or more embodiments, an increase in energy expenditures of primary cooling sources is required to cause an increase in volumetric or mass flow rate and/or decrease in supply water temperature, resulting in increased costs. In one or more embodiments, fouling will additionally result in a loss of air handling unit cooling capacity and insufficient air cooling.

Figure 5:
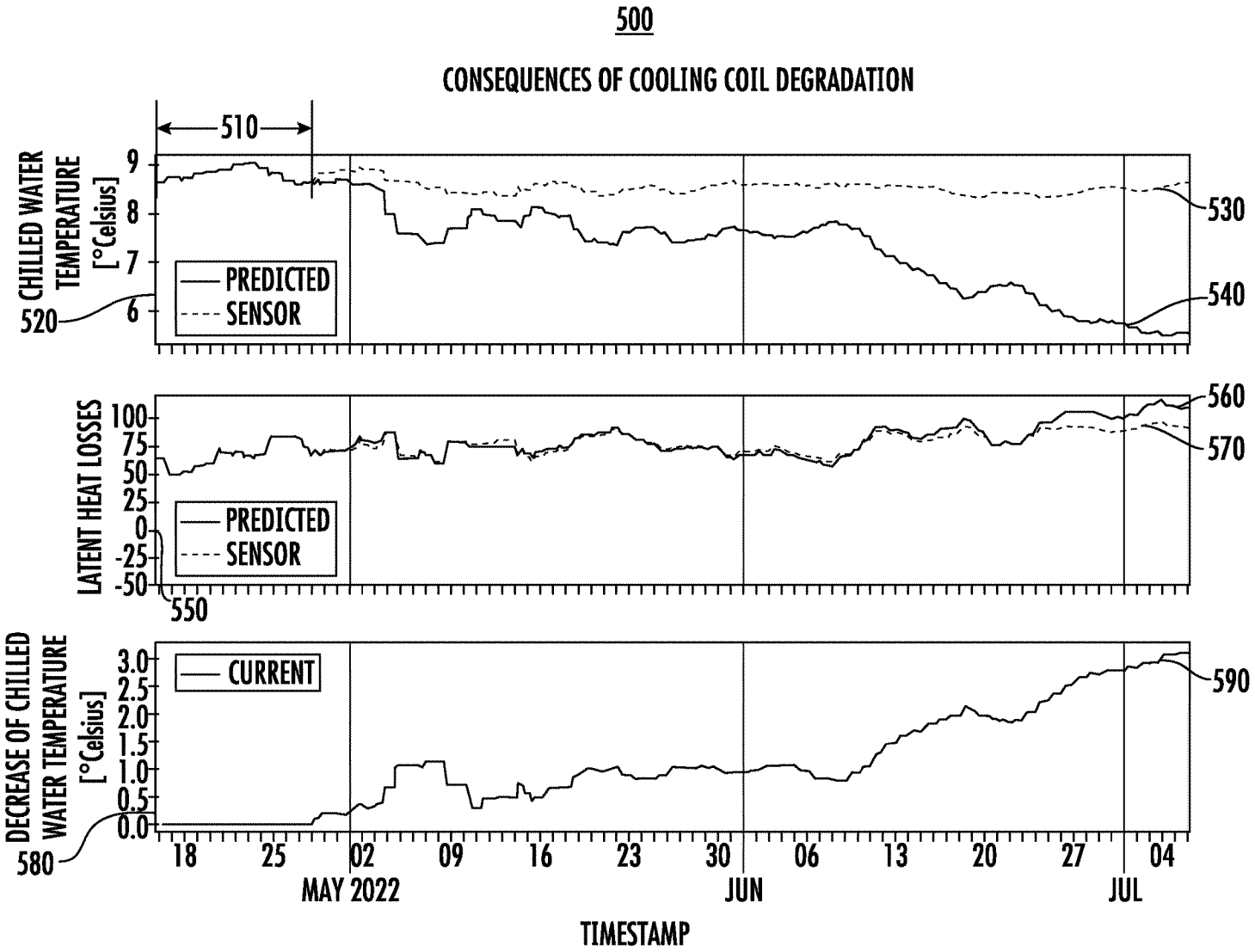
FIG. 5 illustrates example cooling coil degradation models, in accordance with some example embodiments described herein.

Turning now to FIG. 5, a plurality of graphs are provided representing collected and predicted heat transfer data. In one or more embodiments, graph 520 represents a graph of the predicted and actual chilled water supply temperature. In one or more embodiments, a lower chilled water temperature is needed to produce the same cooling effect as cooling coil fouling occurs. In one or more embodiments, the chilled water supply temperature is read at sensor 350. In one or more embodiments, other data may be used to track the fouling of cooling coils. For example, volumetric or mass flow rate of supply water may be tracked, with an increase over time indicating an increase in cooling coil fouling due to a control system having to increase the volumetric or mass flow rate to meet air cooling requirements.

In one or more embodiments, a machine learning model is trained based on the chilled water supply temperature over a first time period. In one or more embodiments, the time period for which the machine learning model is trained is the time period 510. In one or more embodiments, the time period 510 is selected based on a range of possible input data in each period. In one or more embodiments, time periods with a wider range of input data are considered to be more suitable for training. In one or more embodiments, the time period with the widest range of input data is determined using graphical representation. In alternative embodiments, the time period with the widest range of input data is determined using a coverage score. In one or more embodiments, the machine learning model is trained based on data collected at any of sensors 310-360. In one or more embodiments, the machine learning model comprises a regression model. In one or more embodiments, the machine learning model comprises an XGBoost model. In one or more embodiments, the machine learning model may comprise an artificial neural network. In one or more embodiments, the machine learning model generates a data prediction based on the chilled water supply temperature data during the 530. In one or more embodiments, the data prediction predicts the chilled water supply temperature data based on an assumption of the cooling coil degradation level during time period 510 being maintained. In one or more embodiments, the data prediction predicts the chilled water supply temperature data based on the degradation status of a cooling coil during training interval 510. In one or more embodiments, the data prediction comprises predicted chilled water supply temperature. In other embodiments, the graph may predict other data such as volumetric or mass flow rate. In one or more embodiments, the data prediction predicts the chilled water supply temperature over a second time period. In one or more embodiments, actual chilled water supply temperature is compared to predicted chilled water supply temperature over the course of the second time period. In one or more embodiments, actual chilled water supply temperature is represented by line 540.

Graph 550 illustrates another way that cooling coil degradation may be modeled. In one or more embodiments, the machine learning model generates a data prediction based on a loss in latent heat during the first time period. In one or more embodiments, the data prediction is represented by line 570. In one or more embodiments, the data prediction predicts the loss in latent heat based on the degradation status of the cooling coil during time period 510. In one or more embodiments, the data prediction predicts the loss in latent heat based on an assumption of minimal degradation. In one or more embodiments, the loss in latent heat is calculated based on data collected by any of sensors 310-360. In one or more embodiments, loss in latent heat is due to increased water condensation on the cooling coils. In one or more embodiments, the data prediction predicts the loss in latent heat over a second time period. In one or more embodiments, actual loss in latent heat is compared to predicted loss in latent heat over the course of the second time period. In one or more embodiments, actual loss in latent heat is represented by line 560. In one or more embodiments, even a small increase in latent heat loss may indicate cooling coil degradation.

In one or more embodiments, graph 580 represents. chilled water temperature difference between measured chilled water supply temperature and the chilled water supply temperature predicted by the model. In one or more embodiments, this difference represents how much chilled water temperature decrease is needed in order to maintain the same cooling effect as a cooling coil is fouled. The difference in chilled water temperature between lines 530 and 540 is evaluated over the second time period and is represented by line 590. In one or more embodiments, an increase in chilled water temperature difference describes an increase in an energy expenditure value, as chilled water is supplied at a lower temperature to produce the same air temperature maintenance effect.

Figure 6:
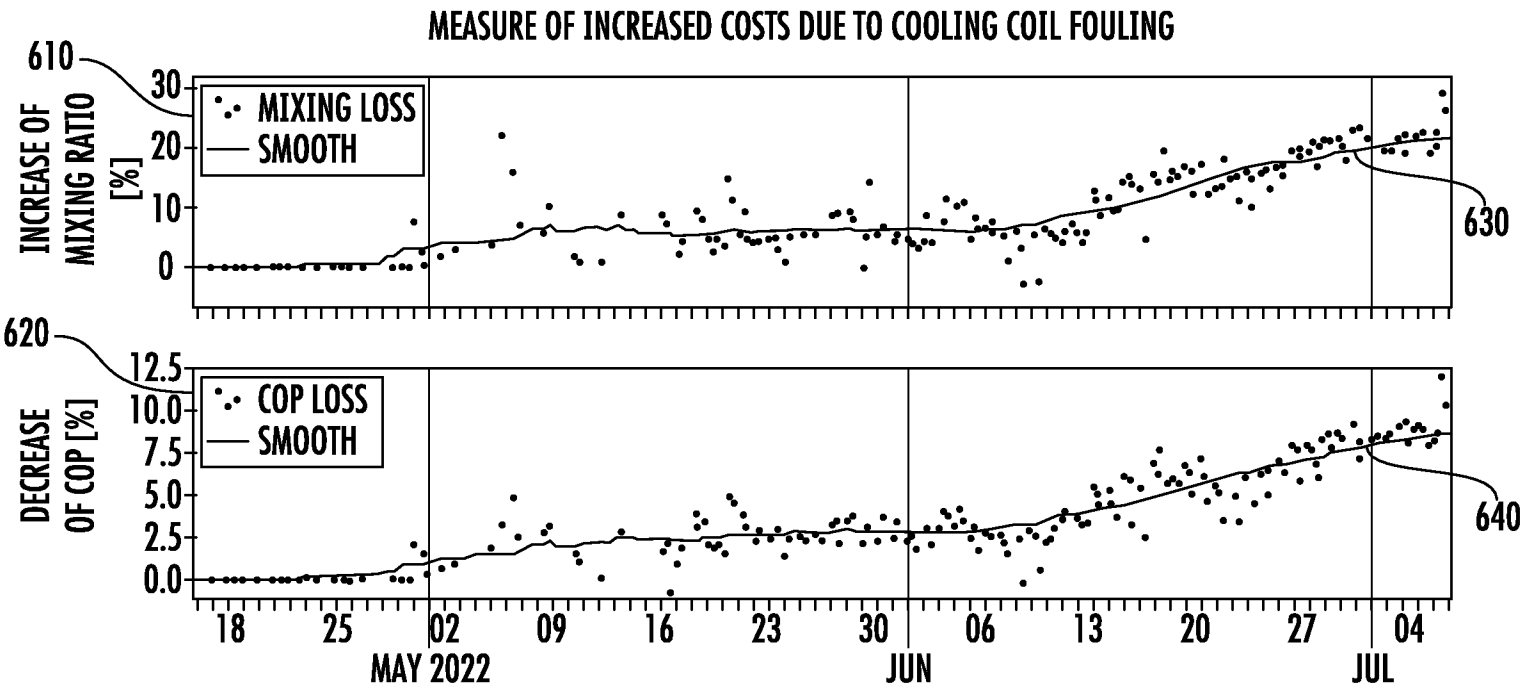
FIG. 6 illustrates example graphs of energy wasted due to cooling coil degradation, in accordance with some example embodiments described herein.

Turning now to FIG. 6, a plurality of graphs are provided illustrating an increase in energy expenditure caused by cooling coil degradation. Graph 610 illustrates an increase in mixing loss that may be caused by cooling coil degradation. In one or more embodiments, supply chilled water and return chilled water may be mixed in a header separate from the unit housing the cooling coils. In one or more embodiments, mixing ratios are used in order to bring water to a correct temperature prior to entering the unit housing the cooling coils. In one or more embodiments, mixing losses can be obtained as percentage of increased chilled water consumption in a mixing ratio. In one or more embodiments, line 630 depicts a smoothed increase in mixing ratios over time as cooling coils foul. In one or more embodiments, an increase in cooling expenditures can be determined based on the increase in mixing loss due to changes in mixing ratio. In one or more embodiments, an increase in expenditure value can be determined based on the increase in mixing ratio. In one or more embodiments, an increase in mixing ratio causes an increase in cold water consumption. In one or more embodiments, this results in an increased energy expenditure value.

Graph 620 illustrates a decrease in chiller coefficient of performance that may be caused by necessary compensation of cooling coil degradation. In one or more embodiments, a required reduction in chilled water supply temperature increases power consumption in a chiller used to chill the chilled water. In one or more embodiments, this causes the chiller to lose efficiency over time, which can be quantified using a coefficient of performance. In one or more embodiments, the coefficient of performance loss increases over time as cooling coils foul. In one or more embodiments, line 640 depicts a smoothed increase in coefficient of performance loss over time as the cooling coils foul. In one or more embodiments, an increase in energy consumed by a chiller providing the supply chilled water can be determined based on the increase in coefficient of performance loss. In one or more embodiments, an increase in expenditure value can be determined based on the increase in coefficient of performance loss. In other embodiments, an increase in expenditure values may be determined by other parameters such as latent heat losses or change in chilled water temperature or flow.

In addition, yet other parameters may be used to determine an amount of energy wasted and/or an increase in expenditure value due to cooling coil fouling. For example, losses in latent heat due to increased water condensation on cooling coils may be used to determine energy waste and/or increase in expenditure value. In one or more embodiments, energy losses can be evaluated where water condensation data is collected and compared to a modeled prediction of water condensation data. In one or more embodiments, an energy difference related to the difference between monitored water condensation data and predicted water condensation data gives relative energy losses. In one or more embodiments, condensation heat data may be collected by sensors deployed to an air handling unit, for example, sensors 310-360. In one or more embodiments, expenditure values can be determined from a decrease in chilled water supply temperature and/or an increase in volumetric or mass flow rate of supply chilled water.

Figure 7A:
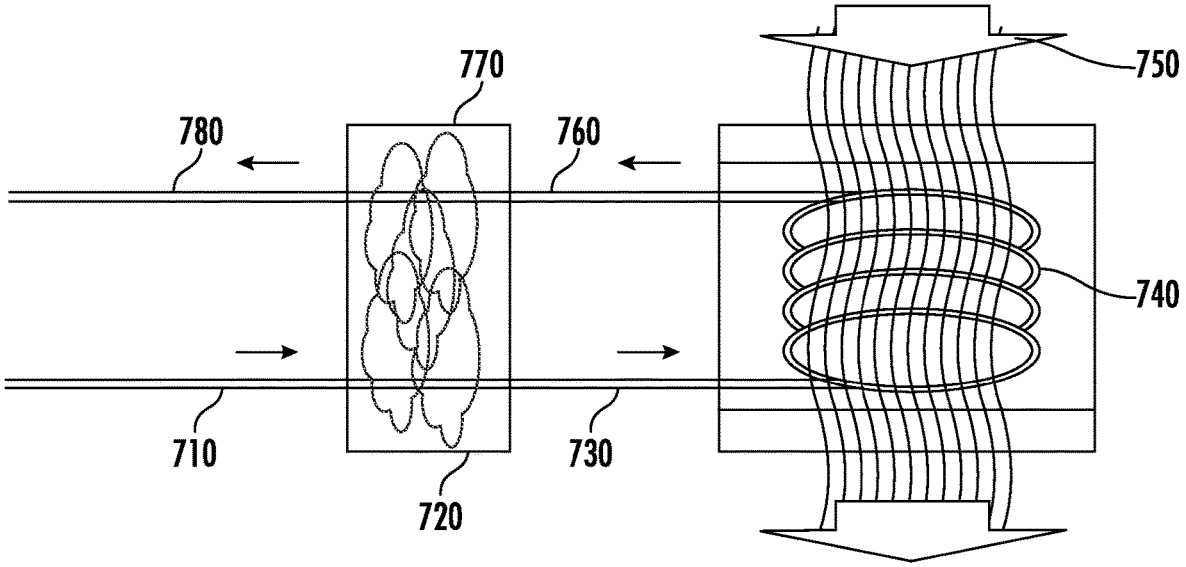
FIGS. 7A-7B illustrate examples of water flow in example air handling units in accordance with some example embodiments described herein.

Turning now to FIG. 7A, an illustration of chilled water being piped into a cooling coil of an air handling unit is provided. In one or more embodiments, at 710, supply chilled water is provided from a chiller or heat exchanger. In one or more embodiments, the supply chilled water may be required to have a lower temperature or higher volumetric or mass flow rate as the air handling unit degrades. In one or more embodiments, at 720, the supply chilled water is mixed with water returning from the air handling unit in header 770. In one or more embodiments, increased energy expenditure can be determined based on the amount of water supplied by the chilled water source and water returned from the AHU mixed in header 770. In one or more embodiments, the mixed chilled water, having reached a proper temperature and flow rate, then travels from the header to the coil at 730. In one or more embodiments, the chilled water runs through the cooling coil 740. In one or more embodiments, air flow 750 passes by the cooling coils. In one or more embodiments, heat transfer occurs between the air flow 750 and cooling coil 740. In one or more embodiments, this results in a rising water temperature and a dropping air temperature. In one or more embodiments, the chilled water then leaves the cooling coil at 760. In one or more embodiments, at 720, the returned chilled water is then mixed with supply chilled water in header 770. In one or more embodiments, a portion of the water is then returned at 780. In one or more embodiments, the remainder of the water returns to the cooling coil at 730.

Figure 7B:
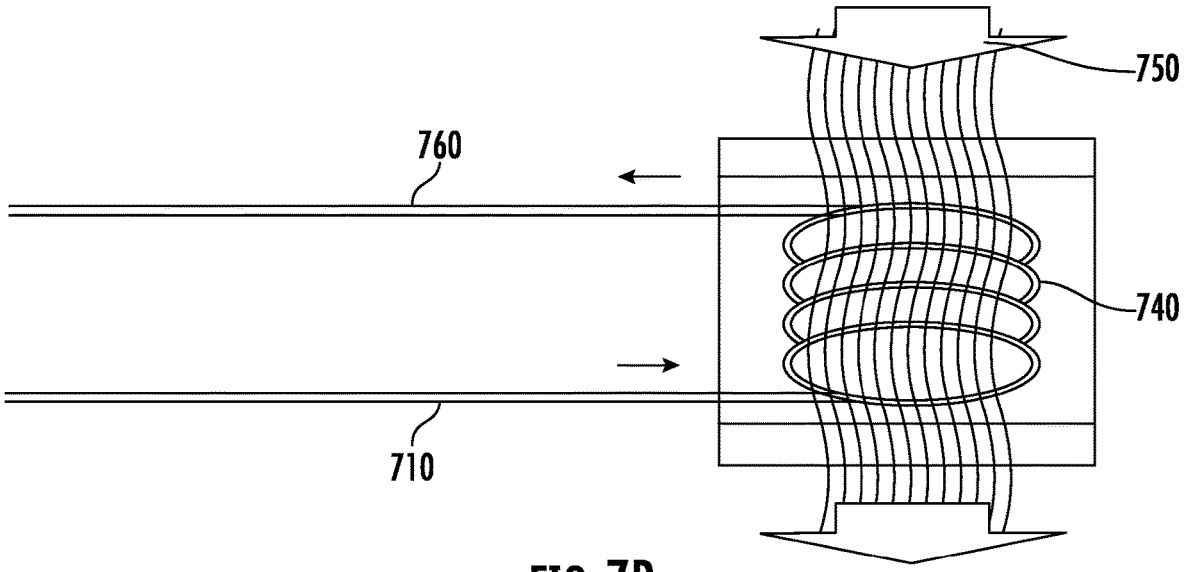

Turning now to FIG. 7B, an illustration of an alternative air handling unit is provided. In one or more embodiments, the supply chilled water is provided from a chiller or heat exchanger at 710. In one or more embodiments, the supply chilled water is transported directly to cooling coils 740 without being mixed. In one or more embodiments, heat transfer degradation of a cooling coil in an air handling unit may be determined by a decrease in supply water temperature or an increase in supply water flow rate, which take place when a control unit responds to cooling coil fouling. In one or more embodiments, the chilled water then travels from into the cooling coil 740. In one or more embodiments, the chilled water runs through the cooling coil 740. In one or more embodiments, air flow 750 passes by the cooling coils. In one or more embodiments, heat transfer occurs between the air flow 750 and cooling coil 740. In one or more embodiments, this results in a higher water temperature and a lower air temperature. In one or more embodiments, the chilled water then leaves the cooling coil at 760. In one or more embodiments, the returned chilled water is returned without being mixed.

Figure 8:
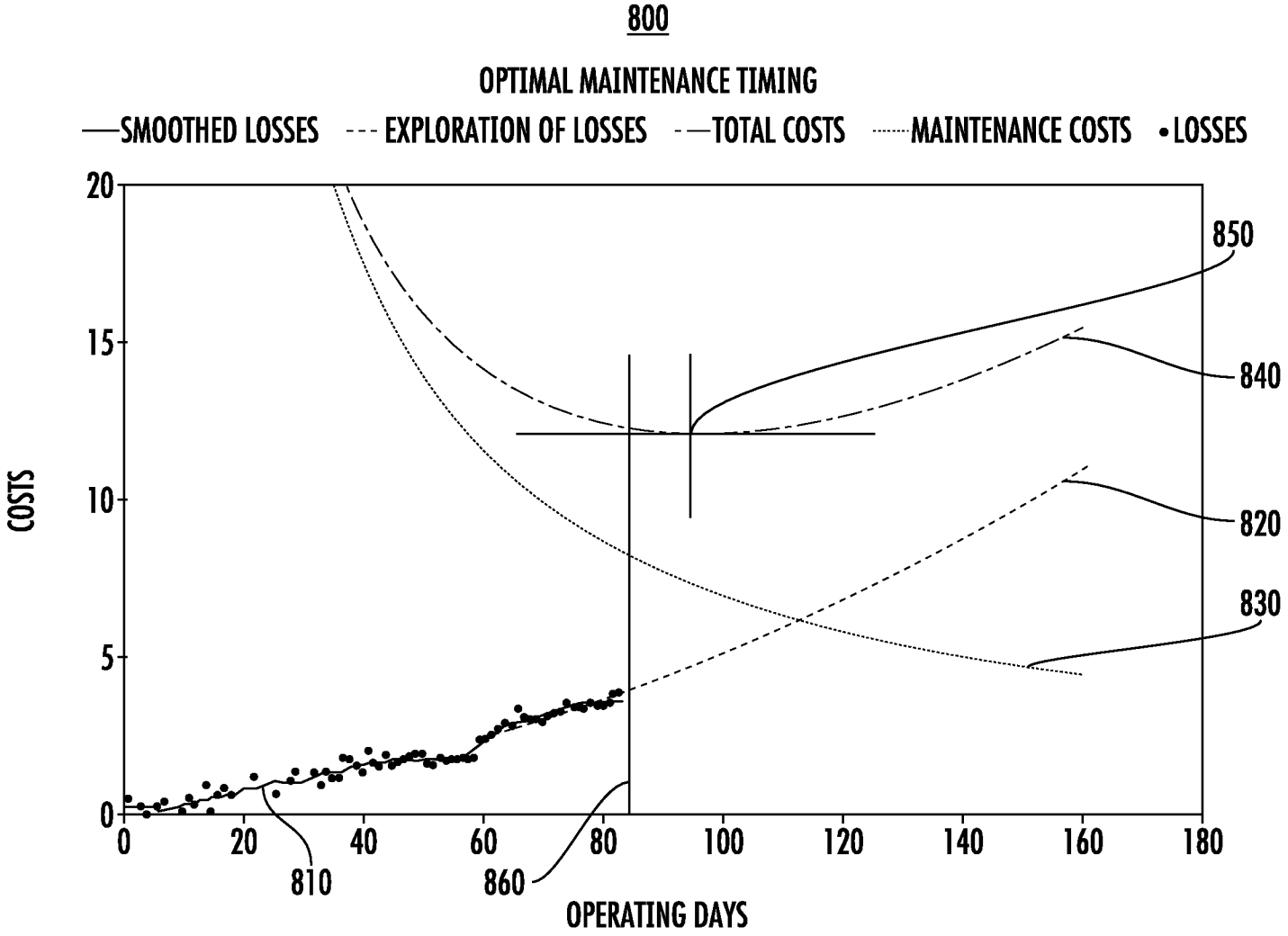
FIG. 8 illustrates an example graph for determining optimal maintenance time, in accordance with some example embodiments described herein.

Turning now to FIG. 8, a graph 800 is provided that illustrates determining an optimal maintenance time for one or more cooling coils. In one or more embodiments, line 810 describes the progress of excess expenditure caused by cooling coil degradation. In one or more embodiments, the excess expenditure is calculated per time interval (e.g., per day). In one or more embodiments, line 810 may be determined based on the difference in power consumption of chilled water supply between the predicted data set and the data collected from sensors 310-360. In one or more embodiments, line 810 is determined based on a difference between predicted mixing ratios and actual mixing ratios over a time interval. In one or more embodiments, the difference is measured per day. In one or more embodiments, line 810 is determined based on a difference between an expenditure value associated with a predicted coefficient of performance and an expenditure value associated with a measured coefficient of performance over a time interval. In one or more embodiments, coefficient of performance is based on temperature of chilled water supply, while temperature of returned water is preserved. In one or more embodiments, line 810 is determined based on a difference between an expenditure value associated with a predicted cooling load of a chiller and an expenditure value associated with a measured cooling load of the chiller. In one or more embodiments, cooling performance of the air handling unit is unchanged throughout the time interval. In other example embodiments, a difference between predicted and measured expenditure value can be calculated using other parameters.

In one or more embodiments, line 820 is determined based on line 810. In one or more embodiments, line 810 may be smoothed to produce line 820. In one or more embodiments, line 820 may be predicted into the future. In one or more embodiments, line 820 describes past degradation losses and future predicted degradation losses.

In one or more embodiments, line 830 represents the cost of cooling coil maintenance. For example, in one or more embodiments, line 830 defines a maintenance cost budget per day.

In one or more embodiments, line 820 and line 830 are combined, for example by totaling or otherwise via summation, to produce line 840. In one or more embodiments, line 840 describes a total cost of operation. In one or more embodiments, line 840 may be given in units of budget per day. In one or more embodiments, line 840 is calculated by determining the cost of maintenance added to the losses caused by degradation of the chiller. In one or more embodiments, the bottom of the line 840 is the estimated optimal point of maintenance 850, estimated at current time 860. In one or more embodiments, at point 850, the total cost of operation is maximally reduced by performing maintenance.

Figure 9:
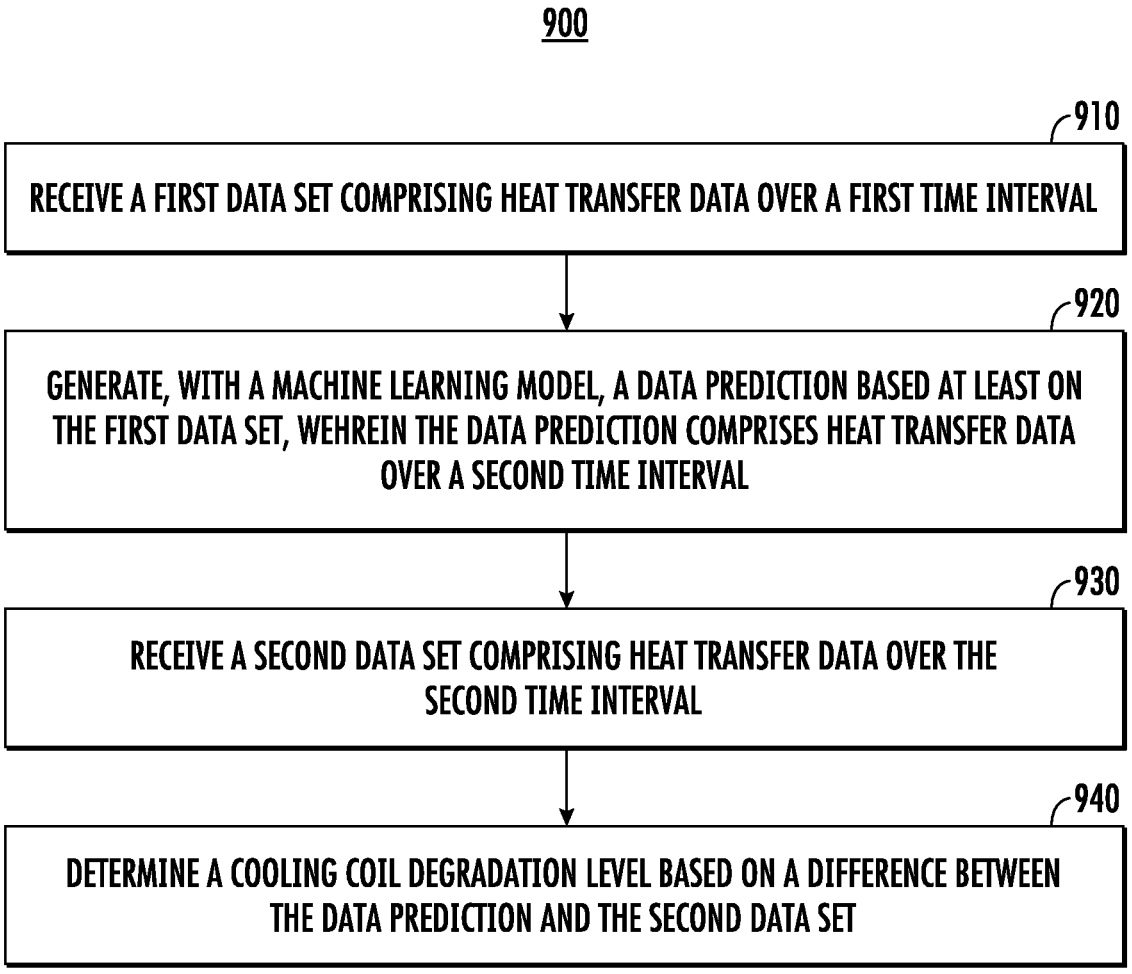
FIG. 9 illustrates an example flowchart for determining a cooling coil degradation level, in accordance with some example embodiments described herein.

Turning now to FIG. 9, a flowchart 900 is shown for determining a cooling coil degradation level. The operations illustrated in FIG. 9 may, for example, be performed by, with the assistance of, and/or under the control of an apparatus (e.g., heat transfer server 108), as described above. In this regard, performance of the operations may invoke one or more of processor 202, memory 204, input/output circuitry 206, communications circuitry 208, forecasting circuitry 210, and/or display circuitry 212.

As shown in operation 910 of FIG. 9, the apparatus (e.g., heat transfer server 108) includes means, such as input/output circuitry 206, communications circuitry 208, or the like, for receiving a first data set comprising heat transfer data over a first time interval. In one or more embodiments, the first data set comprises temperatures of a chilled water entering and/or leaving cooling coils. In one or more embodiments, the first data set comprises a difference between a chilled water supply temperature and chilled water return temperature. In one or more embodiments, the first data set comprises temperatures of air prior and/or subsequent to passing through the cooling coil unit. In one or more embodiments, the first data set comprises volumetric or mass flow rates of the chilled water prior and/or subsequent to flowing through a cooling coil. In one or more embodiments, the first data set comprises relative and/or absolute humidity of air prior or subsequent to passing through the cooling coils. In one or more embodiments, the first data set comprises loss in latent heat. In one or more embodiments, the loss in latent heat is calculated based on data measured from sensors, for example sensors 310-360. In one or more embodiments, the first data set comprises heat removed from air passing through the cooling coils. In one or more embodiments, the heat removed from air passing through the cooling coils is determined based on data measured from sensors, for example sensors 310-360. In one or more embodiments, the heat removed from air passing through the cooling coils is measured by a specialized calorimeter. In one or more embodiments, the first data set is collected from sensors 106, including zero or more of sensors 310-360. In one or more embodiments, the apparatus (e.g., heat transfer server 108) includes means, such as processor 202, forecasting circuitry 210, or the like, for smoothing the first data set, wherein the first data set is smoothed based at least on a third time interval that is longer than a basic sampling time interval and encompasses the basic sampling time interval. For example, a one minute set of data may be smoothed based on a ten minute time interval. In one or more embodiments, smoothing is performed before data processing. In one or more embodiments, smoothing is performed after data processing. In one or more embodiments, data may be smoothed before and after data processing. In one or more embodiments, the length of first time interval is determined based at least on a rate of expected degradation. In one or more embodiments, a faster rate of expected degradation is correlated with a shorter first time interval. In one or more embodiments, a slower rate of expected degradation is correlated with a longer first time interval As shown in operation 920 of FIG. 9, the apparatus (e.g., heat transfer server 108) includes means, such as processor 202, forecasting circuitry 210, or the like, for generating, with a machine learning model, a data prediction based upon the first data set, wherein the data prediction comprises expected heat transfer data over a second time interval. In one or more embodiments, the data prediction is modeled based on a cooling coil degradation level associated with the first data set. In one or more embodiments, the data prediction comprises temperatures of a chilled water entering and/or leaving cooling coils. In one or more embodiments, the data prediction comprises a difference between a chilled water supply temperature and chilled water return temperature. In one or more embodiments, the data prediction comprises volumetric or mass flow rates of the chilled water prior and/or subsequent to flowing through a cooling coil. In one or more embodiments, the data prediction comprises relative and/or absolute humidity of air prior or subsequent to passing through the cooling coils. In one or more embodiments, the data prediction comprises loss in latent heat. In one or more embodiments, the machine learning model comprises a regression model. In one or more embodiments, the machine learning model comprises an XGBoost model. In one or more embodiments, the machine learning model comprises an artificial neural network. In one or more embodiments, the machine learning model is trained based on the first data set.

As shown in operation 930 of FIG. 9, the apparatus (e.g., heat transfer server 108) includes means, such as processor 202, forecasting circuitry 210, or the like, for receiving a second data set comprising heat transfer data over the second time interval. In one or more embodiments, the second data set comprises temperatures of a chilled water entering and/or leaving cooling coils. In one or more embodiments, the second data set comprises a difference between a chilled water supply temperature and chilled water return temperature. In one or more embodiments, the second data set comprises temperatures of air prior and/or subsequent to passing by through the cooling coils. In one or more embodiments, the second data set comprises volumetric or mass flow rates of the chilled water prior and/or subsequent to flowing through a cooling coil. In one or more embodiments, the second data set comprises relative and/or absolute humidity of air prior or subsequent to passing through the cooling coils. In one or more embodiments, the second data set comprises loss in latent heat. In one or more embodiments, the second data set comprises heat removed from air passing through the cooling coils. In one or more embodiments, the second data set is collected from sensors 106, including zero or more of sensors 310-360.

As shown in operation 940 of FIG. 9, the apparatus (e.g., heat transfer server 108) includes means, such as input/output circuitry 206, communication circuitry 208, or the like, for determining a cooling coil degradation level. In some embodiments, the cooling coil degradation level is determined based on a difference between the data prediction and the second data set. In one or more embodiments, the cooling coil degradation level comprises a progress of degradation over the second time interval. In one or more embodiments, the difference between the data prediction and the second data set comprises a difference between a time profile of predicted heat transfer coefficient and a time profile of an actual heat transfer coefficient determined from data over the second time interval. In one or more embodiments, the cooling coil degradation level is determined based at least on a difference between a heat transfer coefficient associated with the data prediction and a heat transfer coefficient associated with the second data set. In one or more embodiments, the cooling coil degradation level is determined based at least on a difference between a logarithmic mean temperature difference associated with the data prediction and a logarithmic mean temperature difference associated with the second data set.

In one or more embodiments, the first data set and the second data set may contain more types of data than the data prediction. In one or more embodiments, the data prediction comprises data indicative of a cooling coil degradation level, while the first data set and the second data set may comprise data indicative of cooling coil degradation level as well as other data relating to air handling unit performance.

Figure 10:
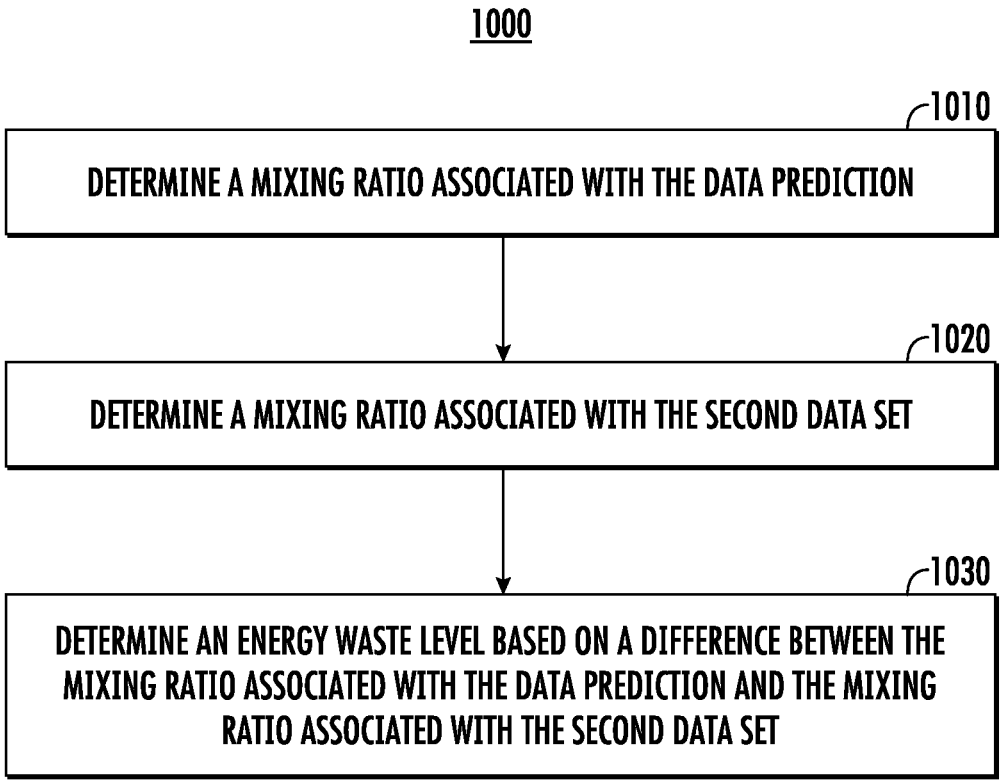
FIG. 10 illustrates an example flowchart for determining an energy waste level based on mixing ratios in accordance with some example embodiments described herein.

Turning now to FIG. 10, a flowchart 1000 is shown for determining an energy waste level based on a difference between predicted and actual mixing ratios. The operations illustrated in FIG. 10 may, for example, be performed by, with the assistance of, and/or under the control of an apparatus (e.g., heat transfer server 108), as described above. In this regard, performance of the operations may invoke one or more of processor 202, memory 204, input/output circuitry 206, communications circuitry 208, forecasting circuitry 210, and/or display circuitry 212.

As shown in operation 1010 of FIG. 10, the apparatus (e.g., heat transfer server 108) includes means, such as processor 202, forecasting circuitry 210, or the like, for determining a mixing ratio associated with the data prediction. In one or more embodiments, the mixing ratio associated with the data prediction is indicative of a predicted energy expenditure level.

As shown in operation 1020 of FIG. 10, the apparatus (e.g., heat transfer server 108) includes means, such as processor 202, forecasting circuitry 210, or the like, for determining a mixing ratio associated with the second data set. In one or more embodiments, the mixing ratio associated with the second data set is indicative of an energy expense level.

As shown in operation 1030 of FIG. 10, the apparatus (e.g., heat transfer server 108) includes means, such as processor 202, forecasting circuitry 210, or the like, for determining an energy waste level based on a difference between the mixing ratio associated with the data prediction and the mixing ratio associated with the second data set. In one or more embodiments, the apparatus (e.g., heat transfer server 108) includes means, such as processor 202, forecasting circuitry 210, or the like, for determining an excess expenditure value based on the amount of energy wasted. In one or more embodiments, the excess expenditure value can be predicted into the future using the machine learning model. In one or more embodiments, the apparatus (e.g., heat transfer server 108) includes means, such as processor 202, forecasting circuitry 210, or the like, for determining an optimal maintenance time based on the excess expenditure value and a cost of maintenance. In one or more embodiments, the excess expenditure value per day may be added to the per day cost of maintenance. In one or more embodiments, the lowest total of the excess expenditure value per day and the per day cost of maintenance describes the optimal maintenance time.

Figure 11:
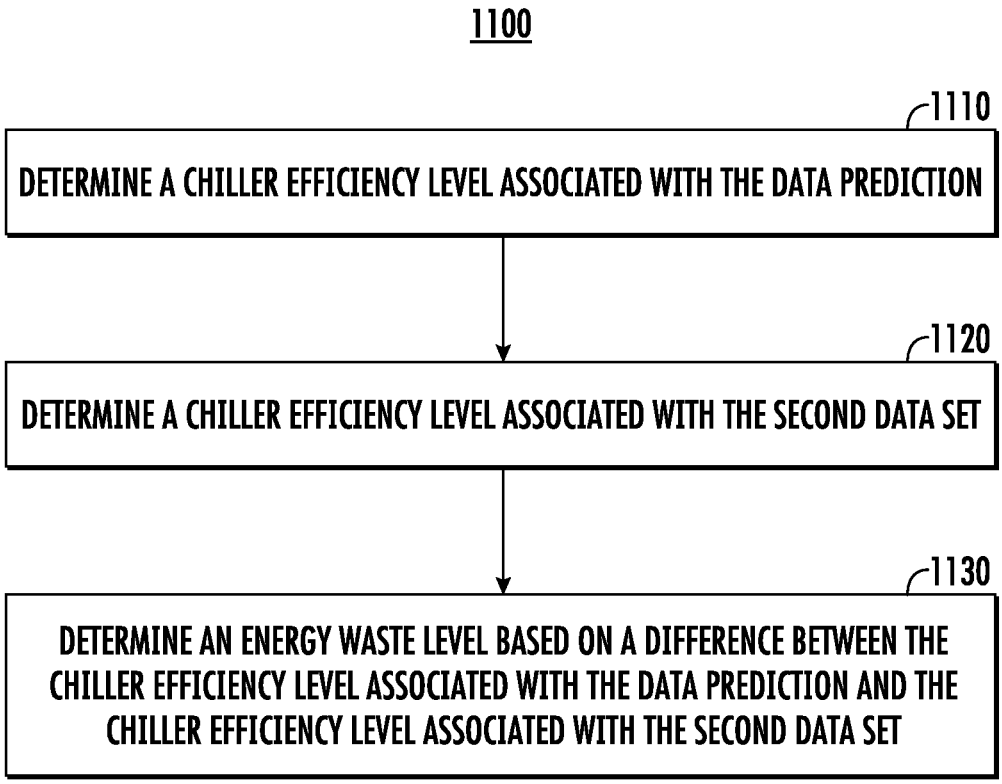
FIG. 11 illustrates an example flowchart for determining an energy waste level based on chiller efficiency levels in accordance with some example embodiments described herein.

Turning now to FIG. 11, a flowchart 1100 is shown for determining an energy waste level based on a difference between predicted and actual chiller efficiency levels. The operations illustrated in FIG. 11 may, for example, be performed by, with the assistance of, and/or under the control of an apparatus (e.g., heat transfer server 108), as described above. In this regard, performance of the operations may invoke one or more of processor 202, memory 204, input/output circuitry 206, communications circuitry 208, forecasting circuitry 210, and/or display circuitry 212.

As shown in operation 1110 of FIG. 11, the apparatus (e.g., heat transfer server 108) includes means, such as processor 202, forecasting circuitry 210, or the like, for determining a chiller efficiency level associated with the data prediction. In one or more embodiments, the chiller efficiency level over time is described by a coefficient of performance. In one or more embodiments, a decrease in supply water temperature causes a decrease in coefficient of performance.

As shown in operation 1120 of FIG. 11, the apparatus (e.g., heat transfer server 108) includes means, such as processor 202, forecasting circuitry 210, or the like, for determining a chiller efficiency level associated with the second data set. In one or more embodiments, the chiller efficiency level over time is described by a coefficient of performance. In one or more embodiments, a decrease in supply water temperature causes a decrease in coefficient of performance.

As shown in operation 1130 of FIG. 11, the apparatus (e.g., heat transfer server 108) includes means, such as processor 202, forecasting circuitry 210, or the like, for determining an energy waste level based on a difference between the chiller efficiency level associated with the data prediction and the chiller efficiency level associated with the second data set. In one or more embodiments, the apparatus (e.g., heat transfer server 108) includes means, such as processor 202, forecasting circuitry 210, or the like, for determining an excess expenditure value based on the amount of energy wasted. In one or more embodiments, the excess expenditure value can be predicted into the future using the machine learning model. In one or more embodiments, the apparatus (e.g., heat transfer server 108) includes means, such as processor 202, forecasting circuitry 210, or the like, for determining an optimal maintenance time based on the excess expenditure value and a cost of maintenance. In one or more embodiments, the excess expenditure value per day may be added to the per day cost of maintenance. In one or more embodiments, the lowest total of the excess expenditure value per day and the per day cost of maintenance describes the optimal maintenance time.

FIGS. 9-11 thus illustrate flowcharts describing the operation of apparatuses, methods, and computer program products according to example embodiments contemplated herein. It will be understood that each flowchart block, and combinations of flowchart blocks, may be implemented by various means, such as hardware, firmware, processor, circuitry, and/or other devices associated with execution of software including one or more computer program instructions. For example, one or more of the operations described above may be implemented by an apparatus executing computer program instructions. In this regard, the computer program instructions may be stored by a memory 204 of heat transfer server 108 and executed by a processor 202 of the heat transfer server 108. As will be appreciated, any such computer program instructions may be loaded onto a computer or other programmable apparatus (e.g., hardware) to produce a machine, such that the resulting computer or other programmable apparatus implements the functions specified in the flowchart blocks. These computer program instructions may also be stored in a computer-readable memory that may direct a computer or other programmable apparatus to function in a particular manner, such that the instructions stored in the computer-readable memory produce an article of manufacture, the execution of which implements the functions specified in the flowchart blocks. The computer program instructions may also be loaded onto a computer or other programmable apparatus to cause a series of operations to be performed on the computer or other programmable apparatus to produce a computer-implemented process such that the instructions executed on the computer or other programmable apparatus provide operations for implementing the functions specified in the flowchart blocks.

The flowchart blocks support combinations of means for performing the specified functions and combinations of operations for performing the specified functions. It will be understood that one or more blocks of the flowcharts, and combinations of blocks in the flowcharts, can be implemented by special purpose hardware-based computer systems which perform the specified functions, or combinations of special purpose hardware with computer instructions.

CONCLUSION

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What is claimed is:

1. An apparatus for determining cooling coil degradation, the apparatus comprising at least one processor and at least one non-transitory memory including computer-coded instructions thereon, the computer-coded instructions configured to, with the at least one processor, cause the apparatus to:

receive a first data set comprising heat transfer data over a first time interval;

generate, with a machine learning model, a data prediction based at least on the first data set, wherein the data prediction comprises heat transfer data over a second time interval;

receive a second data set comprising heat transfer data over the second time interval;

determine a cooling coil degradation level based on a difference between the data prediction and the second data set; and wherein the apparatus further caused to:

determine a mixing ratio associated with the data prediction;

determine a mixing ratio associated with the second data set; and determine an energy waste level based on a difference between the mixing ratio associated with the data prediction and the mixing ratio associated with the second data set.

2. The apparatus of claim 1, wherein the first data set and the second data set comprise a difference between chilled water supply temperature and chilled water return temperature.

3. The apparatus of claim 1, wherein the first data set, data prediction, and second data set comprise loss in latent heat.

4. The apparatus of claim 1, wherein the cooling coil degradation level is determined based at least on a difference between a heat transfer coefficient associated with the data prediction and a heat transfer coefficient associated with the second data set.

5. The apparatus of claim 1, wherein the cooling coil degradation level is determined based at least on a difference between a logarithmic mean temperature difference associated with the data prediction and a logarithmic mean temperature difference associated with the second data set.

6. The apparatus of claim 1, the apparatus further caused to:

determine a chiller efficiency level associated with the data prediction;

determine a chiller efficiency level associated with the second data set; and determine an energy waste level based on a difference between the chiller efficiency level associated with the data prediction and the chiller efficiency level associated with the second data set.

7. The apparatus of claim 1, the apparatus further caused to:

determine an excess expenditure value based on the energy waste level.

8. The apparatus of claim 7, the apparatus further caused to:

determine an optimal maintenance time based on the excess expenditure value and a cost of maintenance.

9. The apparatus of claim 1, wherein the first time interval is determined based at least on a rate of expected degradation.

10. The apparatus of claim 1, the apparatus further caused to:

smooth the first data set, wherein the first data set is smoothed based at least on a third time interval that is longer than a basic sampling time interval and encompasses the basic sampling time interval.

11. The apparatus of claim 1, wherein the machine learning model comprises a regression model.

12. The apparatus of claim 1, wherein the machine learning model is trained based on the first data set.

13. A computer-implemented method, comprising:

receiving a first data set comprising heat transfer data over a first time interval;

generating, with a machine learning model, a data prediction based upon the first data set, wherein the data prediction comprises expected heat transfer data over a second time interval;

receiving a second data set comprising heat transfer data over the second time interval; and determining a cooling coil degradation level based on a difference between the data prediction and the second data set; and wherein the computer-implemented method further comprising:

determining a mixing ratio associated with the data prediction;

determining a mixing ratio associated with the second data set; and determining an energy waste level based on a difference between the mixing ratio associated with the data prediction and the mixing ratio associated with the second data set.

14. The computer-implemented method of claim 13, wherein the first data set and the second data set comprise a difference between chilled water supply temperature and chilled water return temperature.

15. The computer-implemented method of claim 13, wherein the first data set, data prediction, and second data set comprise loss in latent heat.

16. The computer-implemented method of claim 13, wherein the cooling coil degradation level is determined based at least on a difference between a heat transfer coefficient associated with the data prediction and a heat transfer coefficient associated with the second data set.

17. The computer-implemented method of claim 13, wherein the cooling coil degradation level is determined based at least on a difference between a logarithmic mean temperature difference associated with the data prediction and a logarithmic mean temperature difference associated with the second data set.

18. A computer program product comprising at least one non-transitory computer-readable storage medium having computer program code stored thereon that, in execution with at least one processor, is configured for:

receiving a first data set comprising heat transfer data over a first time interval;

generating, with a machine learning model, a data prediction based upon the first data set, wherein the data prediction comprises expected heat transfer data over a second time interval;

receiving a second data set comprising heat transfer data over the second time interval; and determining a cooling coil degradation level based on a difference between the data prediction and the second data set; and wherein the processor is further configured to:

determining a mixing ratio associated with the data prediction;

determining a mixing ratio associated with the second data set; and determining an energy waste level based on a difference between the mixing ratio associated with the data prediction and the mixing ratio associated with the second data set.

19. The computer program product of claim 18, wherein the first data set and the second data set comprise a difference between chilled water supply temperature and chilled water return temperature.

* * * * *